US008226376B2

(12) United States Patent
Krosgsgård et al.

(10) Patent No.: US 8,226,376 B2
(45) Date of Patent: Jul. 24, 2012

(54) PRESSURE EXCHANGER FOR TRANSMITTING PRESSURE ENERGY FROM A FIRST LIQUID STREAM TO A SECOND LIQUID STREAM

(75) Inventors: Holger Krosgsgård, Hadsten (DK); Erik B. Svarre, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 0 days.

(21) Appl. No.: 12/747,064

(22) PCT Filed: Oct. 31, 2008

(86) PCT No.: PCT/EP2008/009191

§ 371 (c)(1), (2), (4) Date: Sep. 9, 2010

(87) PCT Pub. No.: WO2009/074195

PCT Pub. Date: Jun. 18, 2009

(65) Prior Publication Data

US 2011/0008182 A1 Jan. 13, 2011

(30) Foreign Application Priority Data

Dec. 11, 2007 (EP) ..... 07023903

(51) Int. Cl.
*F04F 99/00* (2009.01)

(52) U.S. Cl. ..... 417/71; 417/66; 417/67

(58) Field of Classification Search ..... 417/65, 417/66, 71, 67
See application file for complete search history.

(56) References Cited

U.S. PATENT DOCUMENTS

| | | | |
|---|---|---|---|
| 6,158,422 | A | 12/2000 | Blank et al. |
| 2007/0137170 | A1 | 6/2007 | Bross et al. |

FOREIGN PATENT DOCUMENTS

| | | | |
|---|---|---|---|
| EP | 0 298 097 | B1 | 1/1989 |
| EP | 1 508 361 | A1 | 2/2005 |
| JP | 62 055418 | A | 3/1987 |
| WO | 97/20134 | A1 | 6/1997 |
| WO | 2006015682 | A1 | 2/2006 |

*Primary Examiner* — Charles Freay
*Assistant Examiner* — Patrick Hamo
(74) *Attorney, Agent, or Firm* — Panitch Schwarze Belisario & Nadel LLP

(57) ABSTRACT

A pressure exchanger for transmitting pressure energy from a first fluid flow to a second fluid flow includes a housing having an entry and an exit for the first fluid flow and an entry and an exit for the second fluid flow. A rotor arranged in the housing includes a multitude of channels which extend radially distanced to a rotation axis of the rotor. The rotor is arranged to the entries and exits in a manner such that the channels, on rotation of the rotor, in each case in an alternating manner, connect the entry for the first fluid flow to the exit for the second fluid flow, and the entry for the second fluid flow to the exit for the first fluid flow, and with a drive motor via which the rotor may be driven in rotation, and with setting means for changing the rotational speed of the rotor.

7 Claims, 5 Drawing Sheets

PRESSURE EXCHANGER FOR TRANSMITTING PRESSURE ENERGY FROM A FIRST LIQUID STREAM TO A SECOND LIQUID STREAM

CROSS-REFERENCE TO RELATED APPLICATIONS

This application is a Section 371 of International Application No. PCT/EP2008/009191, filed Oct. 31, 2008, which was published in the German language on Jun. 18, 2009, under International Publication No. WO 2009/074195 A1 and the disclosure of which is incorporated herein by reference.

BACKGROUND OF THE INVENTION

The present invention relates to a pressure exchanger for transmitting pressure energy from a first fluid flow to a second fluid flow.

Such a pressure exchanger is known, for example, from EP 0 298 097 B1 and serves for transmitting pressure energy from a first fluid flow to a second fluid flow. Such pressure exchangers are, in particular, applied in seawater desalination plants. In such plants, salt water is led under pressure at the entry side. The supplied seawater then flows over membranes, through which the desalinated water passes, and is led away as a second fluid flow. Highly concentrated brine arises at the entry side of the membrane, and this exits the plant under pressure. It is the task of the pressure exchanger to recover a part of the pressure energy which this exiting brine contains, and to lead it again to the supplied sea water, in order to reduce the energy requirement of the plant.

The problem with such prior art pressure exchangers of the construction type which is known from EP 0 298 097 B1, is the fact that any undesirable mixing of salt water and brine may occur in the pressure exchanger, since both fluid flows are not completely separated from one another.

BRIEF SUMMARY OF THE INVENTION

With regard to the above-identified problem, it is the object of the present invention to improve a pressure exchanger in a manner such that an as large as possible efficiency and a reliable operation of the pressure exchanger is simultaneously achieved, and an undesired mixing of the two fluid flows with one another is avoided.

The object is achieved by a pressure exchanger with the features specified in the independent claim(s) of the present application. Preferred embodiments are to be deduced from the dependent claims, the subsequent description as well as the attached figures.

The pressure exchanger according to the present invention serves for transmitting pressure energy from a first fluid flow to a second fluid flow. The first fluid flow may for example be brine, which exits from a sea water desalination plant, while the second fluid flow may be a fluid flow of salt water, which is led to the seawater desalination plant. The application of the pressure exchanger according to the present invention is, however, not limited to seawater desalination plants, but may also be applied to other plants, with which pressure energy is to be transmitted from a first fluid flow to a second one.

The pressure exchanger according to the present invention comprises a housing which has an entry and an exit for the first fluid flow, as well as an entry and an exit for the second fluid flow. Thereby, the entry and the exit for the first fluid flow are preferably arranged at a first axial end, and the entry and well as the exit for the second fluid flow, at a second axial end. Moreover, a rotor is arranged in the housing, which comprises a multitude of channels which extend radially distanced from a rotation axis of the rotor from a first axial end of the rotor to an opposite, second axial end of the rotor. This means that the channels connect the two axial sides of the rotor to one another. Thereby, a plurality of channels is distributed over the periphery of the rotor. The rotor is arranged with respect to the entries and exits for the first fluid flow as well as the second fluid flow, in a manner such that on rotation of the rotor, the channels in each case connect the entry for the first fluid flow to the exit for the second fluid flow, and the entry for the second fluid flow to the exit for the first fluid flow, in an alternating manner. The pressure exchanger for this comprises preferably connection elements at its axial ends, on which elements the described entries and exits for the two fluid flows are formed. This means that the first connection element is provided for the first fluid flow at one axial end, and a second connection element for the second fluid flow at the opposite axial end, wherein the rotor is situated in the axial direction between the two connection elements. Moreover, the connection elements are designed such that the entries and exits situated in them, are not directly connected to one another. Rather, the entries and exists in each case face the rotor, so that they may align with the channels in the rotor, depending on the rotation axis of the rotor. This construction corresponds basically to that known from EP 0 298 097 B1.

The manner of functioning of the pressure transmitter is such that the pressure of the first fluid flow which is greater, is transmitted from the entry for this first fluid flow, via one or more channels in the rotor, to the exit for the second fluid flow. In this manner, the pressure energy is transmitted from the first fluid flow to the second fluid flow. If the motor then is rotated further, the channels, which are responsible for the previously described pressure energy transmission, come into a position, in which they are aligned to the entry for the second fluid flow and to the entry for the first fluid flow. Thereby, then pressure energy is transmitted from the entry of the second fluid flow to the exit of the first fluid flow.

Usually, the volume flow of the first fluid flow with a greater pressure is lower than the volume flow of the second fluid flow with a lower pressure. A mixing of the fluid flows according to the present invention should be avoided, in particular between the entry for the fluid flow with the greater pressure and the exit for the fluid flow with the lower pressure. When used in a seawater desalination pant, the salt water is led to the seawater desalination plant from the exit for the second fluid flow, i.e. the fluid flow with the lower pressure. For this reason, one should prevent a part of the brine which exits from the seawater desalination plant and has a greater pressure, from passing into this second fluid flow, since in this case, the seawater desalination installation would be supplied with an unnecessarily high salt concentration. However, it is less of a problem if the fluid flows partly mix on the other side of the pressure exchanger between the exit from the first fluid flow and the entry for the second fluid flow, since its mixing would only cause the fluid from the second fluid flow to pass into the first fluid flow. In the case of the application in a seawater desalination plant, this would mean that fresh seawater passes into the exiting brine which as a rule is not any problem. If the volume flow of the second fluid flow is larger, then as a result, a mixing and a certain passing of the second fluid into the exit for the first fluid flow would always occur on this side.

According to the present invention, a drive motor, preferably an electric drive motor is provided for rotating the rotor. What is essential to the present invention is that setting means are present, by way of which the rotational speed of the rotor may be changed. This may in particular be effected by way of changing the rotational speed of the drive motor. These setting means permit an adaptation of the rotor speed to the current constraints of the installation, in particular to the current volume flow of the first fluid flow and the second fluid flow. The rotational speed of the rotor may thereby be adapted to the volume flows, such that an optimal pressure transmission is effected, without the fluid flows having to mix with one another more than is necessary. On operation of such a pressure exchanger, a mixing zone forms in the channels, in which the two fluid flows come into contact with one another. On exchange of the pressure energy, this mixing zone moves in the channels in the axial direction. In order to avoid a real mixing of the fluid flows between the entry for the first fluid flow and the exit for the second fluid flow, this mixing zone however must advantageously always remain in the inside of the channel. Simultaneously, in order to achieve a high efficiency of the pressure exchanger, the distance by which this mixing zone moves in the axial direction should be as large as possible, preferably correspond to almost the complete length of the channel in the axial direction. The movement of the mixing zone however depends on external parameters, in particular the pressure differences and the volume flows as well as the rotational speed of the rotor. If now, the rotational speed of the rotor may be changed, it is possible to always adapt the rotational speed of the rotor, such that the mixing zone remains in the inside of the channel and the efficiency is simultaneously maximized.

Preferably a control and regulation (closed-loop control) device is provided, via which the rotational speed of the rotor may be set. This is effected further preferably in an automatic manner, in order to operate the pressure exchanger always with a rotor rotational speed, which permits the maximum efficiency at given volume flows and pressure differences.

Further preferably, the control or regulation device are designed in a manner such that it sets the rotational speed of the rotor such that a mixing zone, in which a mixing between the first fluid flow and the second fluid flow occurs, is always situated in the inside of the channels. As described, a mixing of the fluid flows is prevented by way of this. Simultaneously, the control or regulation device preferably executes the control or regulation in a manner such that the axial distance by which the mixing zone moves on rotation of the rotor, is maximized. This ensures the highest possible efficiency.

Usefully, a sensor is present for detecting at least one parameter, at least of one of the fluid flows, and the control or regulation device is designed in a manner such that the rotational speed of the drive motor is set in dependence on the detected parameter. Thus, an automatic adaptation of the rotor rotational speed to the detected parameter is possible, and the operation of the pressure exchanger may be effected depending on the detected parameter, in the region with a maximum efficiency. Thereby, the setting and adaptation of the rotor rotational speed via the setting of the rotational speed of the drive motor may be effected automatically in dependence of the detected parameter or parameters. Preferably, several sensors are provided, in order to detect parameters of the fluid flows at different locations, for example and the entry and exit for the respective fluid flow.

The sensor may preferably be a flow sensor. In this manner, the flow speed and thus the volume flow may be detected and the rotational speed of the drive motor may then be set in dependence on the detected volume flow. Thereby, a sensor may be provided in the first fluid flow and/or in the second fluid flow, in order to be able to then set the rotational speed of the drive motor on the basis of the volume flow of the first fluid flow and such that an optimal efficiency of the pressure exchanger is achieved. It would also be possible to provide pressure sensors for pressure detection and to set the rotational speed on the basis of the detected pressures.

Alternatively or additionally, a sensor may be provided, which is a sensor for detecting the concentration of a substance and in particular of the salt content in the fluid. By way of such a sensor, one may directly monitor as to whether a mixing of the two fluid flows occurs. If this is ascertained, the rotational speed of the drive motor may then be adapted, such that such a mixing no longer occurs, which again is then detected by the sensor or sensors for the concentration detection.

Preferably, in each case, a sensor for detecting the substance concentration is provided for at least one of the two fluid flows in the entry as well as in the exit, and the control or regulation device is designed for detecting the difference between the substance concentrations at the entry and the exit, and for setting the rotational speed of the drive motor in dependence on the detected difference. If the pressure exchange takes place between two fluids or fluid flows which have differently large concentrations of a substance, for example a different salt content, then in this manner one may ascertain whether a mixing of the fluid occurs. If the fluids do not mix, the substance concentration at the exit and entry of a fluid flow should in each case be essentially the same, i.e. the detected difference should have a minimum. If the difference is greater, this indicates that an undesired mixing of the two fluid flows occurs, and the rotational speed of the drive motor may be accordingly adapted by the control and regulation device, in order to set the rotational speed of the drive motor, such that a mixing of the fluid flows does not occur.

For this, preferably the control device is designed such that the rotational speed of the drive motor is controlled with a closed loop, such that the difference of the substance concentrations reaches a minimum. In this manner, the pressure exchanger is always operated such that an as low as possible mixing of the two fluid flows occurs, and simultaneously the maximal efficiency may be achieved.

According to a further preferred embodiment of the present invention, means for detecting the rotational speed of the rotor may be present, in particular a rotational speed sensor may be arranged on the rotor. This permits the current rotational speed to be detected and to be taken into account with the control or and regulation (closed-loop control) of the rotational speed. The control or regulation device may thus obtain a feedback as to how high the actual rotor rotational speed is. Thus, an even more accurate control or regulation of the rotational speed of the drive motor and thus adaptation to the actual operating conditions is possible.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention is hereinafter described by way of example and by way of the attached figures. In these there are shown in the drawings.

DETAILED DESCRIPTION OF THE INVENTION

Figure 1:
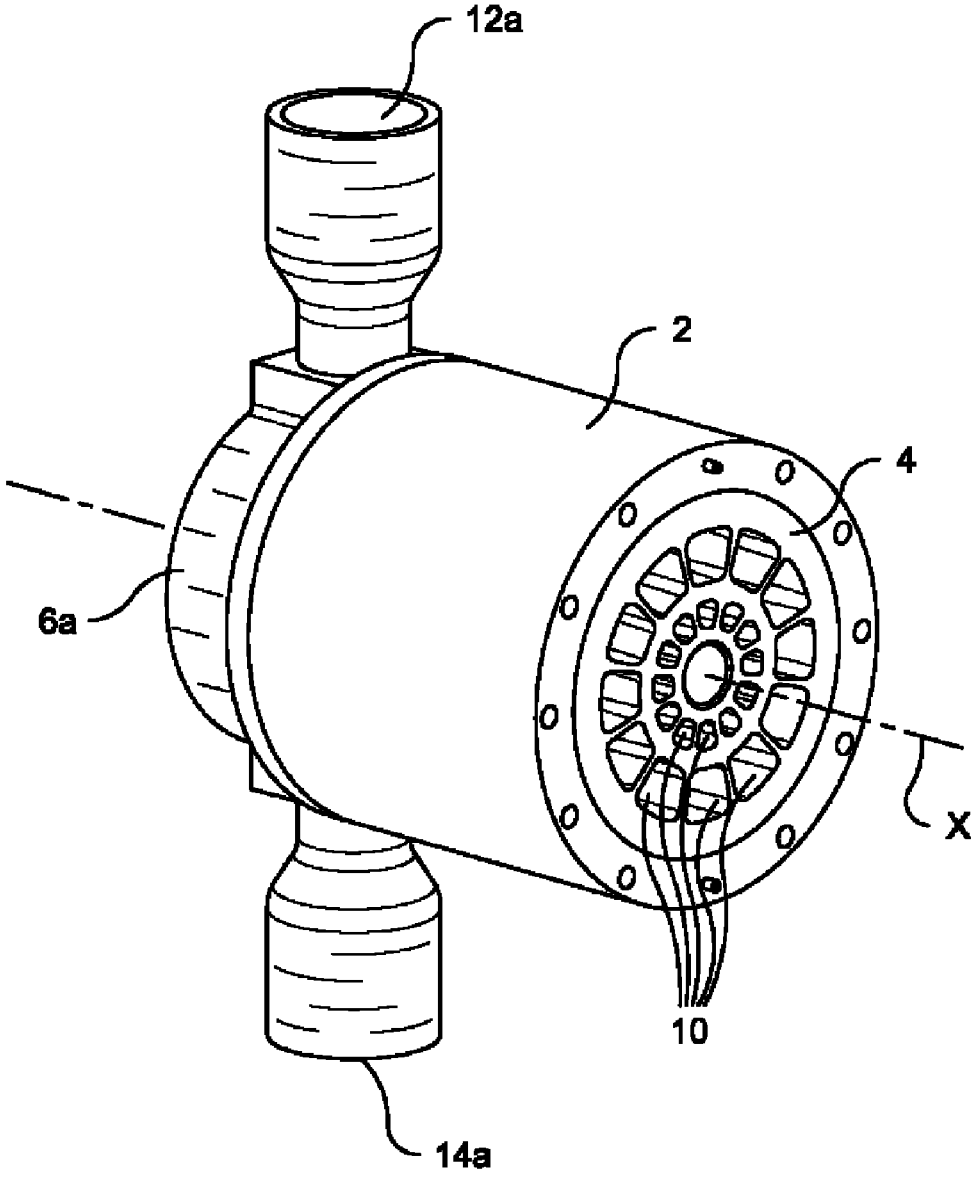
FIG. 1 is a schematic perspective view of a pressure exchanger according to a first preferred embodiment of the present invention, wherein one of the axial connection elements is removed.

Certain terminology is used in the following description for convenience only and is not limiting. Unless specifically set forth herein, the terms "a," "an" and "the" are not limited to one element, but instead should be read as meaning "at least one." The terminology includes the words used herein, derivatives thereof and words of similar import.

Referring to the drawings in detail, wherein like numerals indicate like elements throughout the several views, the geometric construction of the pressure exchanger of the present invention corresponds essentially to the pressure exchanger known from EP 0 298 097 B 1. The pressure exchanger of the present invention comprises a cylindrical housing 2, in whose inside a rotor 4 is arranged in a rotatable manner. Thereby, the rotor 4 is rotatable about the longitudinal axis X of the housing 2 and rotor 4. The housing 2 at the two axial sides is closed in each case by a connection element 6. Both connection elements 6 are designed in an identical manner, and for differentiation, the two connection elements are subsequently indicated at 6*a* and 6*b*. If no differentiation is made, the description relates to identically designed parts. The connection elements 6 are screwed to the housing 2.

The rotor 4 comprises a multitude of channels 10, which extend in the rotor in the axial direction parallel to the longitudinal axis X. Thereby, the channels 10 are arranged circularly about the longitudinal axis X. In the shown example, two concentric rings of channels 10 are provided. This arrangement of two rings of channels is selected for reasons of stability. It is to be understood that other arrangements may also be selected here, for example only one ring of channels which e.g. are larger for this, or more than two rings of channels. The channels 10 connect the two axial ends of the rotor 4 to one another.

Figure 2:
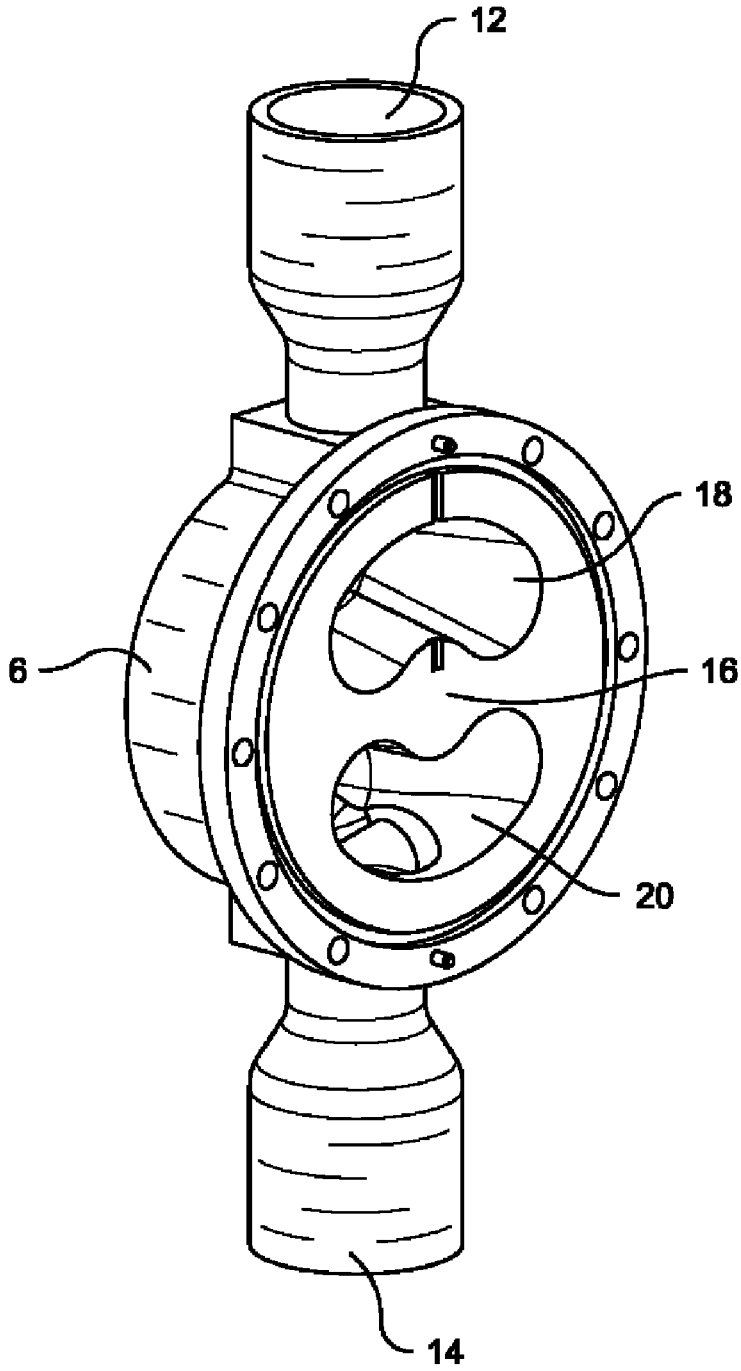
FIG. 2 is a perspective view of a connection element of the pressure exchanger according to FIG. 1.

Each of the connection elements 6 comprises connection unions 12 (12*a*, 12*b*), 14 (14*a*, 14*b*). As is to be recognized in FIG. 2, the connection unions 12, 14 are not directly connected to one another. Rather, a separating wall 16 is formed in the inside of the connection element 6, and divides the inside of the connection element 6 into two parts. Thus, two arch-like recesses 18 (18*a*, 18*b*), 20 (20*a*, 20*b*) which are separated from one another by the separating wall 16 are formed on the surface of the connection element 6, which faces the rotor 4. Thereby, the recess 18 is connected to the connection union 12, and the recess 20 to the connection union 14.

Figure 3:
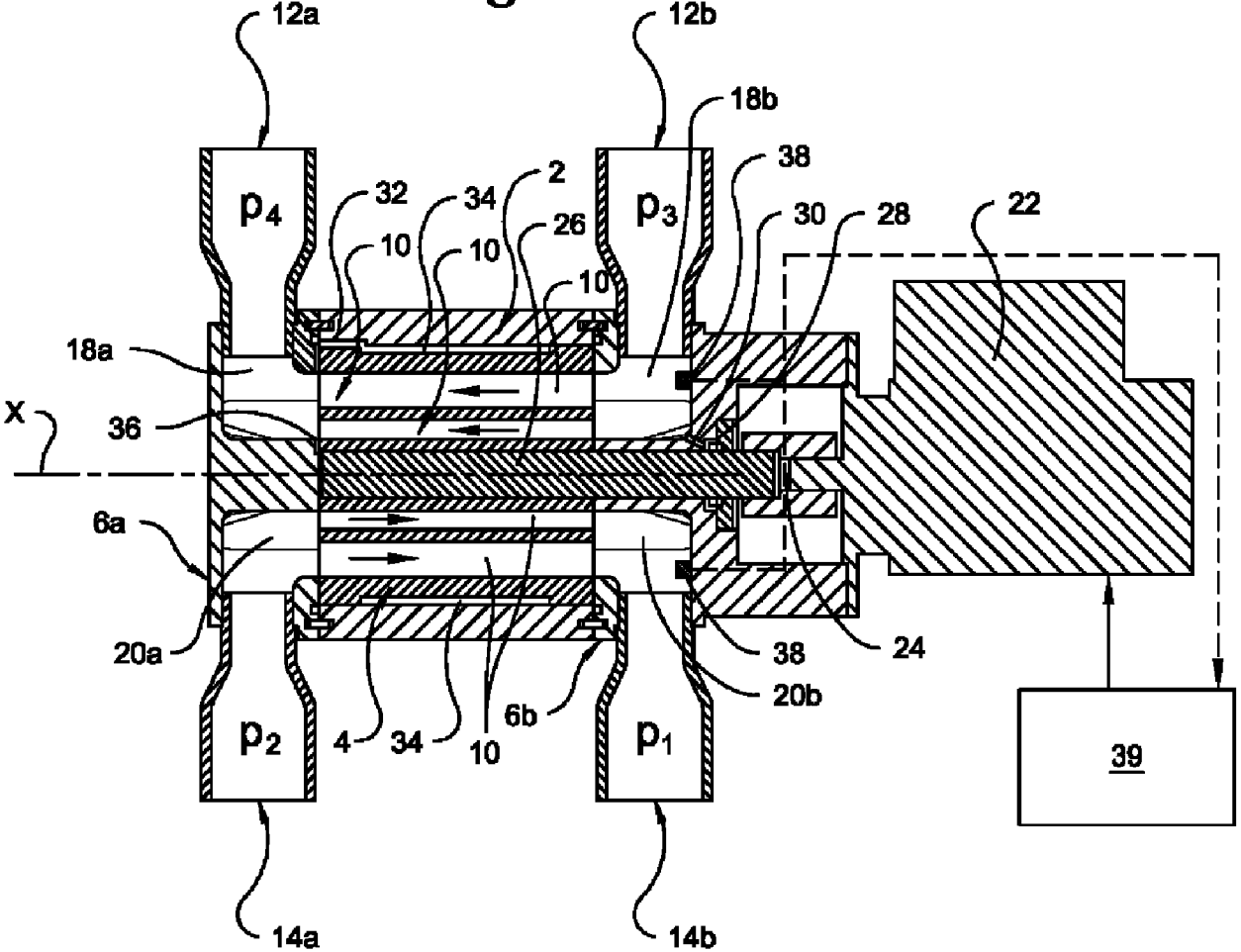
FIG. 3 is a cross-sectional elevation view of the pressure exchanger according to the first preferred embodiment of the present invention.

As is to be recognized in FIG. 3, an electric drive motor 22 is provided, which is connected to the rotor shaft 26 via a coupling 24. The rotor 4 is arranged on the rotor shaft 26 in a rotationally fixed manner, so that it may be rotated by the drive motor 22. A shaft seal 28 is arranged on the rotor shaft 14. The shaft seal 28 is connected via the channel 30 to the recess 18*b*, in order to supply fluid for lubrication. A channel 32 is also provided which, proceeding from the recess 18*a*, leads to the peripheral space 34 between the rotor 4 and the housing 2, in order to lead fluid from this space. In this manner, fluid which penetrates into this space is led away, and too high a pressure in this space is prevented. A channel 36 is also provided, which connects the recess 18*a* to the through-hole in the rotor 4, in which the rotor shaft 26 is situated. Thus, the fluid may also be led away out of this through-hole, in particular for cooling and for lubricating the bearing by fluid entering the channel 30.

The manner of functioning of the pressure exchanger is described hereinafter. The connection unions 12*a*, 14*a* serve for connecting to a conduit system for a first fluid flow, whilst the connections 12*b*, 14*b* serve for connecting to a conduit system for a second fluid flow. The first fluid flow is for example the brine flow which departs from a seawater desalination plant and which still has a large pressure energy which is transmitted to a second fluid flow, for example to a flow of salt water which is to be supplied to the seawater desalination installation. The connection union 14*a* forms an entry for the first fluid flow, for example brine, which is at a pressure $p_2$. The connection 12*a* forms the exit for the first fluid flow at a lower pressure $p_4$.

The connection 14*b* forms the exit for the second fluid flow, for example the salt water, whilst the connection union 12*b* forms the entry for the second fluid flow. The first fluid flow enters the entry 14*a* and the subsequent recess 20*a* at a pressure $p_2$. Since the pressure $p_2$ is greater than the pressure $p_1$, which the fluid of the second fluid flow has at the exit 14*b*, the fluid, proceeding from the entry 14*a*, flows into the channels 10 facing the recess 20*a* and thus transmits the pressure onto the second fluid which is located in these channels, and onto the second fluid in the recess 20*b* and the conduit system connecting to the exit 14*b*, since these channels 10 are also aligned with the recess 20*b*.

Thereby, the two fluids come into contact with one another in the channels 10, wherein these contact zones in the channels 10 are moved to the axial end which faces the recess 20*b* of the connection element 6*b*, on account of the higher pressure $p_2$. That means that in this position, the channels 10 are largely filled with the first fluid from the entry 14*a*. If now the rotor 4 is rotated, these channels 10 which were firstly situated between the recesses 20*a* and 20*b*, come to lie between the recesses 18*a* and 18*b*. The fluid pressure $p_3$ of the ingoing second fluid prevails in the recess 18*b*, and this pressure although being lower than the pressure $p_2$, is however greater than the exit pressure $p_4$ of the first fluid in the recess 18*a*. Due to this, the second fluid flows into the channels 10 and thereby presses the first fluid out of the channels 10 largely into the recess 18*a* and via the connection union 12*a* into a connecting pipe conduit. Thereby, the mixing zone in which the two fluids come into contact with one another in the channels 10, shifts to that axial end of the channels 10, which faces the connection element 6*a* and its recess 18*a*. Since the volume flow of the second fluid is greater than that of the first fluid, a mixing of the fluids occurs on this side of the pressure exchanger, i.e. a part of the second fluid enters into the recess 18*a* and the fluid exiting from the connection 12*a* is mixed with a part of the entering second fluid. If the rotor is now rotated back again into the first described position, so that these mentioned channels 10 are again located between the recesses 20*a* and 20*b*, there the first fluid again flows into the channels 10 and presses the second fluid to the exit 14*b* for the second fluid. Thus, a part of the pressure energy of the first fluid is transmitted onto the second fluid.

It may be recognized that the complete first fluid flow and the complete second fluid flow must be delivered through the channels 10 of the rotor 4. According to the present invention, now one may change the rotational speed of the rotor 4 via the drive motor 22, in order to adapt the rotor rotational speed to the first and the second fluid flow, so that an optimal efficiency is achieved, without a mixing of the two fluids on the side of the pressure exchanger with a greater pressure, i.e. between the recesses 20*a*, 20*b*, from occurring. A mixing would occur if the mixing region, in which both fluids come into contact with one another, leaves the channels 10 at an axial end. For example, if the rotor is rotated too slowly, it may occur that the first fluid flows through the channels 10 between the recesses 20*b*, 20*a* over into the recess 20*b*, before the rotor has rotated any further. Here, the rotational speed of the rotor should be adapted such that such a flow-over does not occur. If however, the rotor rotational speed is too quick, then too little fluid enters into the channels 10. Thus for example the channels 10 between the recesses 20*a*, 20*b*, proceeding from the recess 20*a*, would only be filled with the first fluid to a small extent, before the rotor rotates further. This worsens the efficiency, since then the pressure energy may only be transmitted from the first fluid to the second fluid to a reduced extent. An optimal efficiency is achieved when the contact or mixing region, in which the two fluids are in contact with one another in the channels 10, moves from the position between the recesses 20*a*, 20*b* to the position between the recesses 18*a*, 18*b* essentially over the whole axial length of the channels 10, on rotation of the rotor.

In order to achieve an optimal regulation (closed-loop control), sensors 38 for detecting the salt content are arranged in the recesses 18*b*, 20*b*. The sensors could also be designed for detecting the concentration of substances different to salt, depending on the application location of the pressure exchanger. The sensors 38 are connected via cable or without cable, to a control and regulation device 39 which controls or regulates the rotational speed of the drive motor 22. The control or regulation device 39 determines the difference between the substance concentrations or the salt contents, from the exit signals of the sensors 38. Thus, a change of the salt content in a fluid flowing in through the connection union 12*b* and flowing out through the connection union 14*b*, may be detected. If then for example the first fluid, which is supplied through the connection union 14*a* and led away through the connection union 12*a*, has a greater salt content than the second fluid, which is the case with the described example of a seawater desalination plant, then an increase of the salt content in the second fluid would occur with a mixing of the first and second fluid. If the first fluid, proceeding from the recess 20*a* were to flow over through the channels 10 up to into the recess 20*b*, then this in the recess 20*b* would lead to an increased salt content of the second fluid. This means that that the salt content in the recess 20*b* would be greater than in the recess 18*b*, in which the entering second fluid is located. It would thus be useful to detect a difference of the salt content via the sensors 38.

Figure 4:
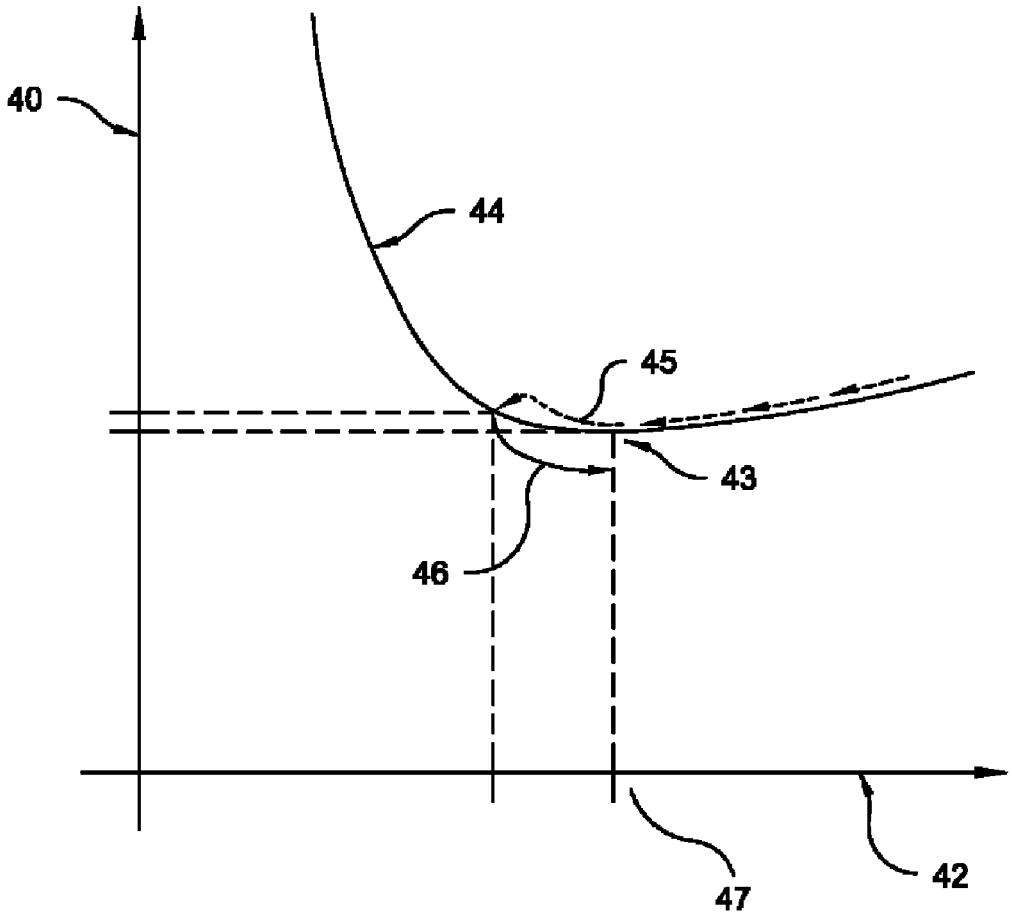
FIG. 4 is a curve which shows a difference of the salt content plotted over the rotational speed of the rotor.

The difference of the salt content 40 is plotted over the rotor rotational speed 42 in FIG. 4. It is to be recognized that this curve 44 has a minimum 43. This minimum 43 is the optimal operating point at which the lowest as possible mixing of the two fluid flows occur. If the rotational speed is too small, then a mixing occurs on account of the fluid flowing over from the recess 20*a* into the recess 20*b*. With a rotational speed which is too high, likewise an increase of the difference of the salt content between the entry and exit for the second fluid likewise occurs, since an increasing mixing of the first and second fluid in the channels 10 occurs, since the channels 10 are not filled essential completely with the first and the second fluid in an alternating manner as was previously described, but rather a part of the fluid always remains in the channels, so that a mixing and a small increase in the salt content in the exit for the second fluid occurs.

The closed-loop control of the rotational speed of the rotor 2 is now effected as follows via the rotational speed of the drive motor 22. Firstly, a rotational speed is selected, which is greater than the rotational speed 47 at the minimal difference 43. Proceeding from this rotational speed, the rotational speed is firstly reduced for as long as the sensors 38 evaluate a decreasing difference of the salt content. This is indicated in the diagram in FIG. 4 by the dashed arrows 45. If then, an increase of the difference of the salt content is detected, the rotor rotational speed is increased again, as is indicated by the arrow 46 in FIG. 4. In this manner, the rotational speed may be regulated to the rotational speed 47 at the minimum 43 of the difference of the salt content between the sensors 38.

In the case that the curve 44 runs such that a straight line forms at a higher rotational speed and thus has no global minimum, the closed-loop control may be effected in a manner such that the rotational speed is set as low as possible. Thereby, the rotational speed is reduced to such an extent, that an increase of the difference of the salt content 40 only just does not occur.

Alternatively to a closed-loop control of the rotational speed by way of the detection of the salt connect in the previously described manner, it is also possible to regulate the rotational speed by way of the volume flow, in that the volume flows of the first and/or the second fluid are detected and are set in dependence of one or both volume flows. For this, a table with an assignment of rotational speeds to volume flows may be stored in the control.

Figure 5:
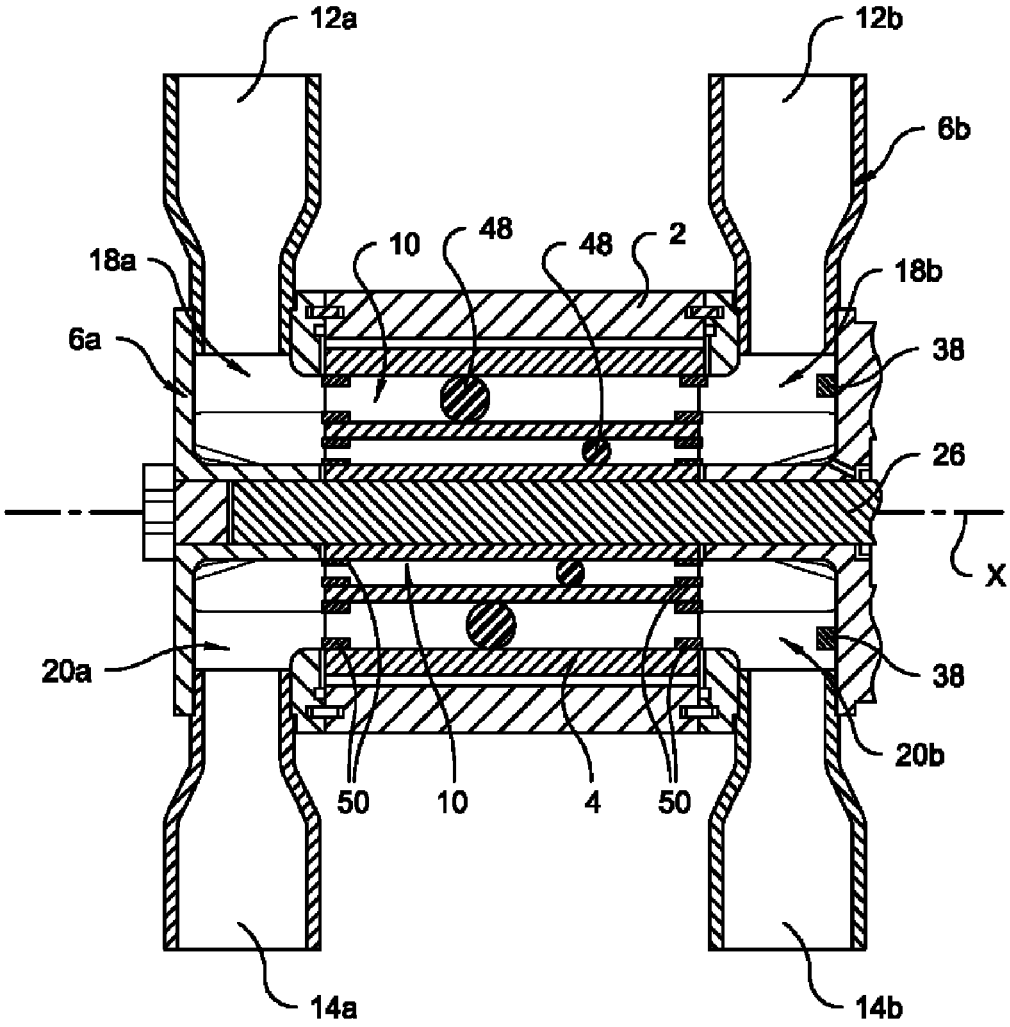
FIG. 5 is a cross-sectional elevation view of a pressure exchanger according to a second preferred embodiment of the present invention.

FIG. 5 shows a further embodiment of the present invention, which only differs from the preceding preferred embodiment described by way of FIG. 3, by way of the fact that ball-like blocking elements 48 are arranged in the channels 10. The blocking elements 48 are movable in the channels 10 along their longitudinal axis. Abutment rings 50 are provided at the axial ends of the channels 10, which prevent the blocking elements 48 from being able to exit the channels 10 at the axial side. The blocking elements 48 prevent the first and the second fluid coming into direct contact with one another in the channels 10. A small contact however is thereby tolerated, since it is to be understood that the blocking elements 48 on account of their movability, may not always be arranged in the channels in a completely sealing manner. On operation of the pressure exchanger according to this preferred embodiment, the blocking elements 48 move when the channels 10 are situated between the recesses 20*a*, 20*b*, ideally firstly up to that axial end of the channels 10, which faces the connection element 6*b*, so that the blocking elements 48 come to lie on the abutment rings 50 at this axial end. If the rotor then rotates into a position such that these channels 10 are situated between recesses 18*a*, 18*b*, the blocking elements 48 are moved to the opposite end of the rotor 4 and come to bear on the abutment rings 50, which face the connection element 6*a*. All remaining elements and the manner of functioning correspond to the manner of functioning explained previously by way of FIG. 3.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A pressure exchanger for transmitting pressure energy from a first fluid flow to a second fluid flow comprising:

a housing (2) having an entry (14*a*) and an exit (12*a*) for the first fluid flow and an entry (14*b*) and an exit (12*b*) for the second fluid flow;

a rotor (4) arranged in the housing (2), the rotor (4) comprising a multitude of channels (10) which extend radially distanced to a rotation axis (X) of the rotor (4), from a first axial end of the rotor (4) to an opposite, second axial end of the rotor (4), the rotor (4) arranged with respect to the entries and exits (12, 14) in a manner such that on rotation of the rotor (4), in each case in an alternating manner, the channels (10) connect the entry (14*a*) for the first fluid flow to the exit (14*b*) for the second fluid flow, and the entry (12*b*) for the second fluid flow to the exit (12*a*) for the first fluid flow;

a drive motor (22) connected to the rotor (4) and via which the rotor (4) is driven in rotation; and a motor controller connected to the drive motor and via which the rotational speed of the drive motor (22) is controlled such that a mixing zone, in which a mixing between the first fluid flow and the second fluid flow occurs, is always situated inside the channels (10).

2. A pressure exchanger according to claim 1 wherein a sensor (38) for detecting at least one parameter of at least of one of the fluid flows is present, and the control or regulation device is designed in a manner such that the rotational speed of the drive motor (22) is set in dependence on the detected parameter.

3. A pressure exchanger according to claim 2, wherein the sensor is a flow sensor.

4. A pressure exchanger according to claim 2, wherein the sensor (38) detects the concentration of salt content in the fluid.

5. A pressure exchanger according to claim 4, wherein at least for one of the two fluid flows, in each case the sensor (38) for detecting the salt concentration is present in the entry (12*b*) as well as in the exit (14*b*), and the control or regulation device is designed for detecting the difference (44) between the salt concentrations at the entry (12*b*) and the exit (14*b*), and for setting the rotational speed of the drive motor in dependence on the detected difference (44).

6. A pressure exchanger according to claim 5, wherein the control or regulation device is designed in a manner such that it controls the rotational speed of the drive motor (22) with a closed loop, such that the difference (44) of salt concentration reaches a minimum (43).

7. A pressure exchanger according to claim 1, wherein means for detecting the rotational speed of the rotor (4) are present.

* * * * *